US005845856A

United States Patent [19]

Tanaka et al.

[11] Patent Number: 5,845,856

[45] Date of Patent: Dec. 8, 1998

[54] PIN MILL TYPE CRUSHER

[75] Inventors: Hiroaki Tanaka; Toshio Watanabe; Sosuke Naito; Yoshihiko Imai; Toshikatsu Chida; Hideki Nakamura; Kazu Ohya, all of Osaka, Japan

[73] Assignee: Kansai Matec Co., Ltd., Japan

[21] Appl. No.: 749,796

[22] Filed: Nov. 15, 1996

[30] Foreign Application Priority Data

Jun. 13, 1996 [JP] Japan ..... 8-172846

[51] Int. Cl.[6] ..... B02C 13/22

[52] U.S. Cl. ..... 241/79.1; 241/188.2; 241/245; 241/300

[58] Field of Search ..... 241/60, 79, 87, 241/87.1, 89.1, 188.1, 188.2, 245, 296, 79.1, 297, 298, 300

[56] References Cited

U.S. PATENT DOCUMENTS

| | | | |
|---|---|---|---|
| 1,811,438 | 6/1931 | Riley et al. | 241/87.1 |
| 3,219,286 | 11/1965 | Doyle et al. | 241/188.2 |
| 4,203,555 | 5/1980 | Dickson, Jr. | 241/79.1 X |
| 4,522,342 | 6/1985 | Muschenborn et al. | 241/188.2 X |
| 4,580,736 | 4/1986 | Takahashi et al. | 241/188.2 |
| 4,597,537 | 7/1986 | Misaka et al. | 241/79.1 |
| 4,618,415 | 10/1986 | Vecchio | 241/79.1 X |
| 4,626,343 | 12/1986 | Folsberg | 241/79.1 X |
| 4,691,867 | 9/1987 | Iwako et al. | 241/188.2 X |
| 4,813,619 | 3/1989 | Tjumanok et al. | 241/188.2 X |
| 4,824,035 | 4/1989 | Naito et al. | 241/188.2 |
| 5,094,391 | 3/1992 | Tamashige et al. | 241/79.1 |

FOREIGN PATENT DOCUMENTS

| | | | |
|---|---|---|---|
| 6-55053 | 3/1994 | Japan | 241/79.1 |
| 1123722 | 11/1984 | U.S.S.R. | 241/188.2 |
| 1126321 | 11/1984 | U.S.S.R. | 241/188.2 |
| 1595562 | 9/1990 | U.S.S.R. | 241/188.2 |
| 1607942 | 11/1990 | U.S.S.R. | 241/188.2 |
| 1609485 | 11/1990 | U.S.S.R. | 241/188.2 |

*Primary Examiner*—John M. Husar
*Attorney, Agent, or Firm*—Ronald P. Kananen; Rader, Fishman & Grauer

[57] ABSTRACT

A first rotor disk (21) and a second rotor disk (22) having a plurality of crushing pins (30) mounted so as to form rows along the circumference are opposed to each other and rotatably supported within casings (14, 15). The first and second rotor disks (21, 22) are rotated to crush materials to be crushed which are charged into the casings (14, 15). The crushing pins (30) are mounted on the first and second rotor disks (21, 22) in a cantilever manner. Escape spaces are provided on the first and second rotor disks (21, 22) so as to face to the extreme ends of the crushing pins (30).

12 Claims, 7 Drawing Sheets

PIN MILL TYPE CRUSHER

BACKGROUND OF THE INVENTION

This invention relates to a crusher of a disintegrating type and a pin mill type in which one or two rotor disks having a plurality of crushing pins mounted so as to form rows along the circumference are supported within a casing, and the one or two rotor disks are rotated to crush materials to be crushed which are charged into the casing.

The crusher is used to crush stones, gravels, construction wastes, pavement wastes, other wastes, various mineral products, grains, and the like.

The crusher is constructed such that one or more rotor disks having a plurality of crushing pins arranged are supported within a casing, and at least one rotor disk is rotated to crush materials to be crushed which are charged into the casing. See, for example, U.S. Pat. No. 3,503,561.

In the conventional disintegrating type crusher, generally, the crushing pins are mounted in a double end support system. That is, a root portion of the crushing pin is secured to a rotor disk, and an extreme end thereof is secured to a ring-like band.

The sufficient strength could not be obtained if neither the root portion nor the extreme end of the crushing pin are supported.

However, since the bands are secured to the extreme ends of all the crushing pins, the maintenance has been very inconvenient.

For example, even in the case where only one broken pin is replaced, it is necessary to remove the bands from all the crushing pins, and it took much trouble and time.

Further, the conventional pin with a band is of a double end support type. Therefore, the length of the pin was allowed to be relatively long. However, since the band portion (for example, the band portion in the third row) overlaps with pins in before and behind rows (pins in the second and third rows), the full length of the pin is not effectively contributed to the crushing. Further, the dispersibility of raw materials has been poor. This was even a primary factor of an increase in crushing cost.

Because of the presence of the band, the maintenance is inconvenient. The bands violently becomes worn. This also causes the increase in crushing cost.

SUMMARY OF THE INVENTION

It is an object of the present invention to provide a crushing pin type crusher capable of easily replacing crushing pins and capable of improving the crushing efficiency.

The crusher according to the present invention is provided with a first rotor disk and a second rotor disk having a plurality of crushing pins mounted so as to form rows along the circumference. These first and second rotor disks are opposed to each other and rotatably supported within a casing. The crushing pins are mounted in a cantilever manner on the first and second rotor disks. Escape spaces are annularly provided on the first and second rotor disks so as to face to the extreme ends of the crushing pins.

Let Y be the maximum distance between the crushing pin on the side of the first rotor disk and the crushing pin on the side of the second rotor disk, and X be the minimum distance between the extreme end of each of the crushings pins and the bottom of the escape space of the first rotor disk or the second rotor disk facing thereto, and then the relationship of X>Y is established.

The crushing pins are composed of a metal member mounted on the rotor disk in a cantilever manner and a tubular ceramic member detachably mounted on the metal member. The metal member is generally tapering, and the diameter (C) of a root portion of the metal member is 1.0 to 7.0 times the diameter (B) of the extreme end thereof. The diameter (C) of the root portion of the metal member is 1.4 to 3.5 times the diameter (B) of the extreme end thereof. The ceramic member is generally cylindrical, and the length of the ceramic member and the metal member is 1.2 to 5 times the outside diameter (A) of the ceramic member. The diameter of the root portion of the metal member is ¼ to ½times or ⅓ to ⅗ times the outside diameter (A) of the ceramic member.

A packing member or an adhesive such as a rubber tape is arranged between the metal member and the ceramic member.

A keep member is arranged on the extreme end of the ceramic member and the metal member so as to be mounted, and then secured to the extreme end of the metal member by means of a nut. A joining surface of the keep member is formed to be either flat or concave in section.

When in use, the first and second rotor disks are rotated in the fixed direction (the same direction or the opposite direction) to crush materials to be crushed charged into the casing.

For example, the rotor disks are rotated in the directions opposite to each other, and the relative speed of the crushing pins which rotate in the opposite direction is utilized to perform crushing.

A plurality of classifying blades are arranged on the rotor disk. A classifying air direction adjusting means for adjusting the direction of classifying air is provided within the casing.

A classifying air supply means for supplying classifying air is connected to the casing. Classifying air taken into the casing is utilized to separate pulverized powder from the crushed materials.

A classifying chamber for classification is formed in the casing. A plurality of classifying guide valves are arranged on the outside of the classifying chamber to form an inlet of the classifying chamber. An outlet of the classifying chamber is made to serve as a pulverized-powder outlet. Classifying air is fed in the direction of the pulverized-powder outlet from the inlet of the classifying chamber.

One boundary side of the classifying chamber is formed by the side of the rotor disk. A plurality of classifying blades are circularly mounted on said side of the rotor disk, and classification is carried out while rotating the classifying blades.

A classification throttle plate is provided on the pulverized-powder outlet. Thereby, the throttling of the pulverized-powder outlet is adjusted.

A classifying air amount adjusting plate is provided within the casing. The amount of the classifying air taken into the casing is adjusted.

A classifying air direction adjusting plate is provided within the casing. Thereby, the classifying air direction within the casing is adjusted.

DESCRIPTION OF EMBODIMENTS

FIGS. 1 to 4 show embodiments of the crusher according to the present invention. The left and right in the embodiments shown are for the sake of convenience, having no limitative meaning.

In the present invention, the band need not be removed during the maintenance work. Therefore, no band is provided, but the pin is of a cantilever support type so that the length of the pin is shortened.

Even if the pin is shortened, it is necessary to make the crushing ability equal to or more than that of the conventional type. To this end, the full length of the pin is effectively used to disperse raw materials.

Figure 9:
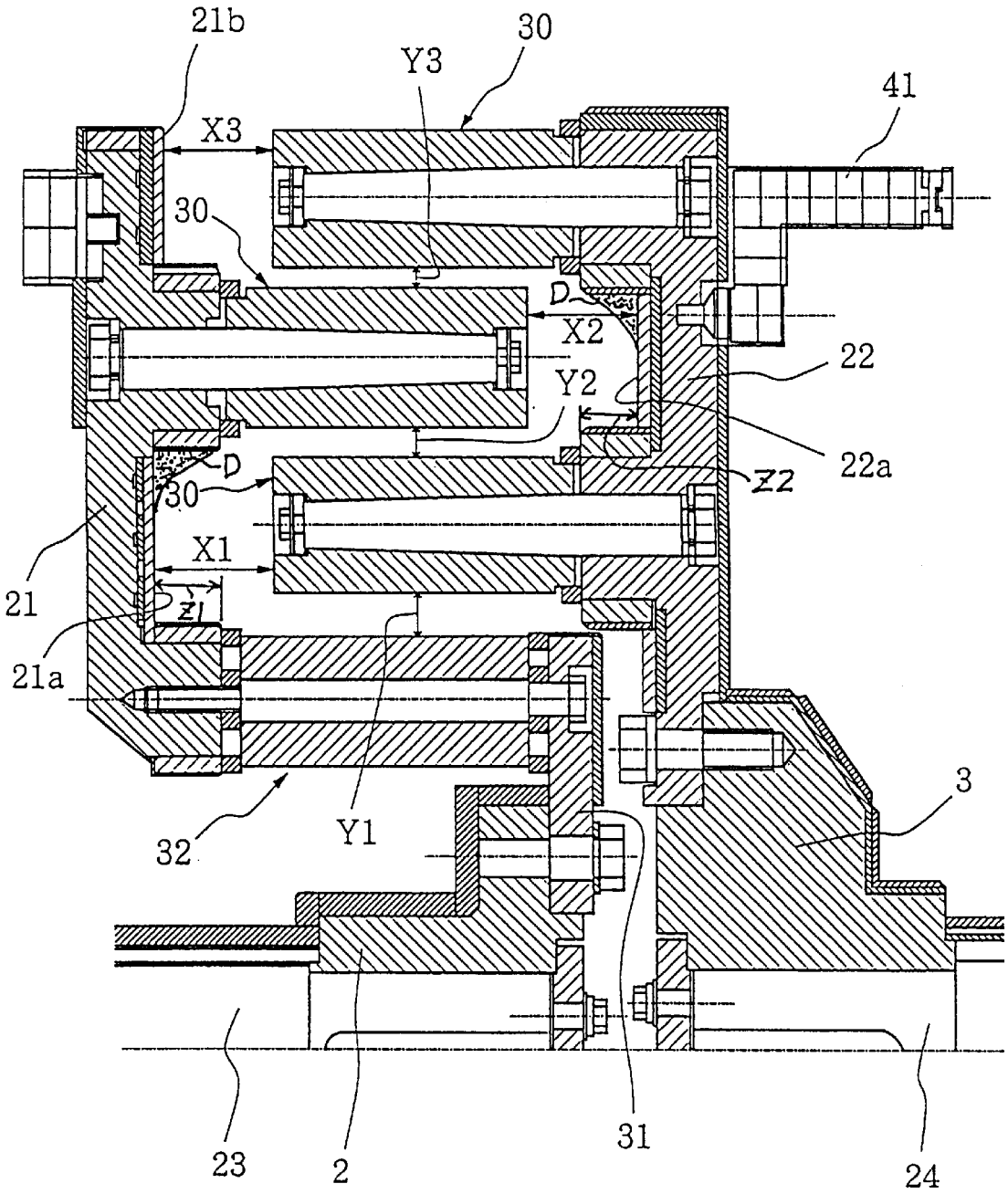
FIG. 9 is a sectional view showing on an enlarged scale the relationship between a first and a second rotor disks, and the crushing pin.

In the conventional machine, when raw materials enter from the center portion of a first row of pins 30, the concentration of the raw materials in the center portion becomes high and that on both left and right ends becomes low while the raw materials flow in order of a second, a third and a fourth rows. So, escape spaces 21*a* and 22*a* are provided as shown in FIG. 9. Thereby, dead spaces D are formed at the upper end of a recess of the escape spaces 21*a* and 22*a*, and the raw materials flow in a horizontal direction from left to right, and right to left along the dead spaces D. The load on the pin 30 is made to be even, and even if the pin 30 is shortened, the full length of the pin 30 can be effectively used. Therefore, the whole ability can be made to be equal to or more than that of the conventional machine. Since no band is provided, the maintenance can be simplified and the crushing cost can be considerably reduced.

A crusher 10 has a base 11, on which a column 12 and a movable column 13 are formed. Casings 14 and 15 for forming a crushing chamber 18 are provided on the column 12 and the movable column 13.

The movable column 13 can be moved in parallel along the longitudinal direction of the base 11 by a retractor (moving means) provided at the right end of the base 11. The retractor 16 is so constituted as to be operated by a retractor operating panel 61 provided on the column 13.

The retractor 16 can be constructed using, for example, a cylinder and piston mechanism, a motor and others.

The base 11 is provided with a guide mechanism for the parallel movement.

Figure 1:
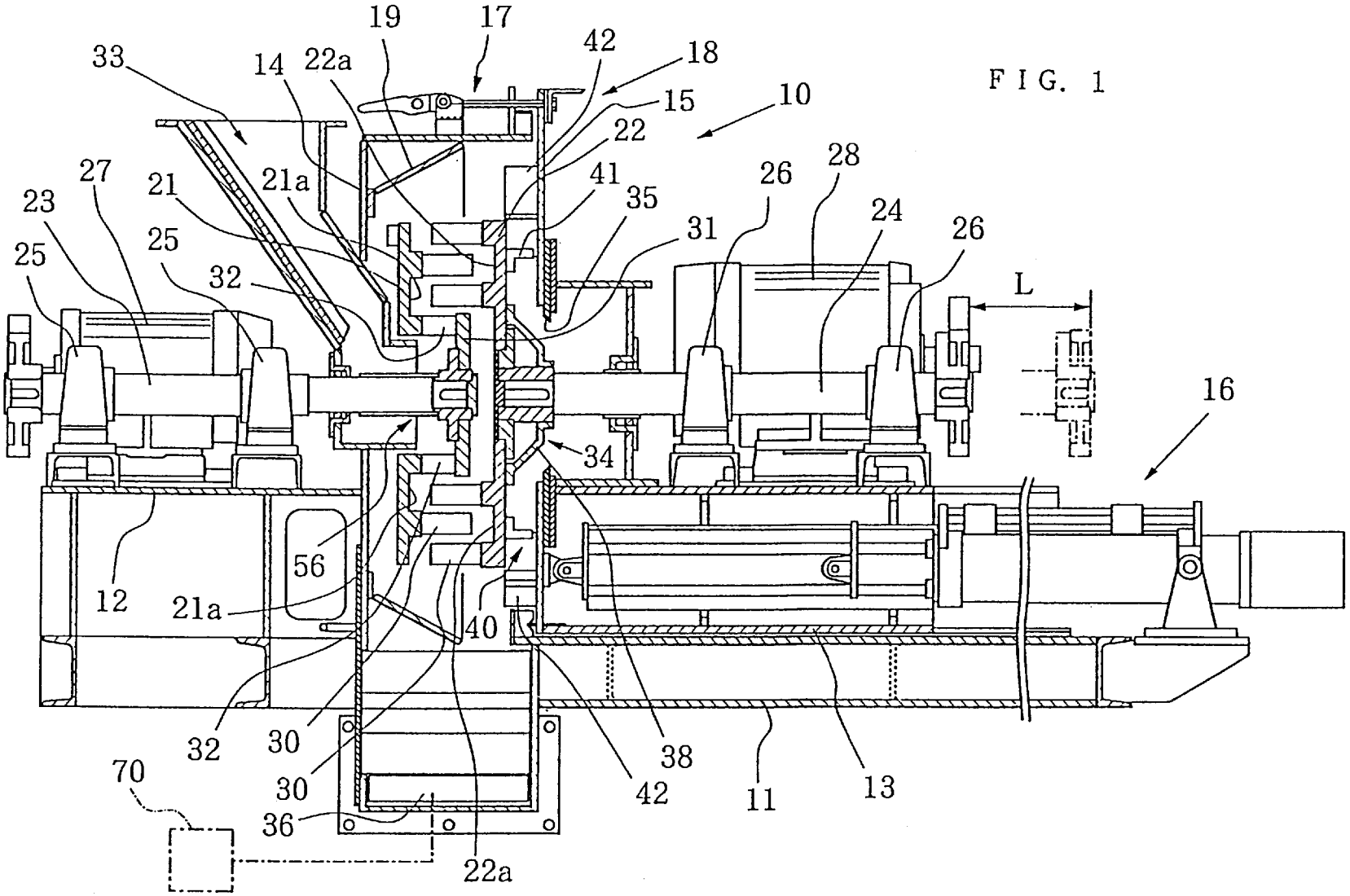
FIG. 1 is a sectional view showing one embodiment of a crusher according to the present invention.
Figure 2:
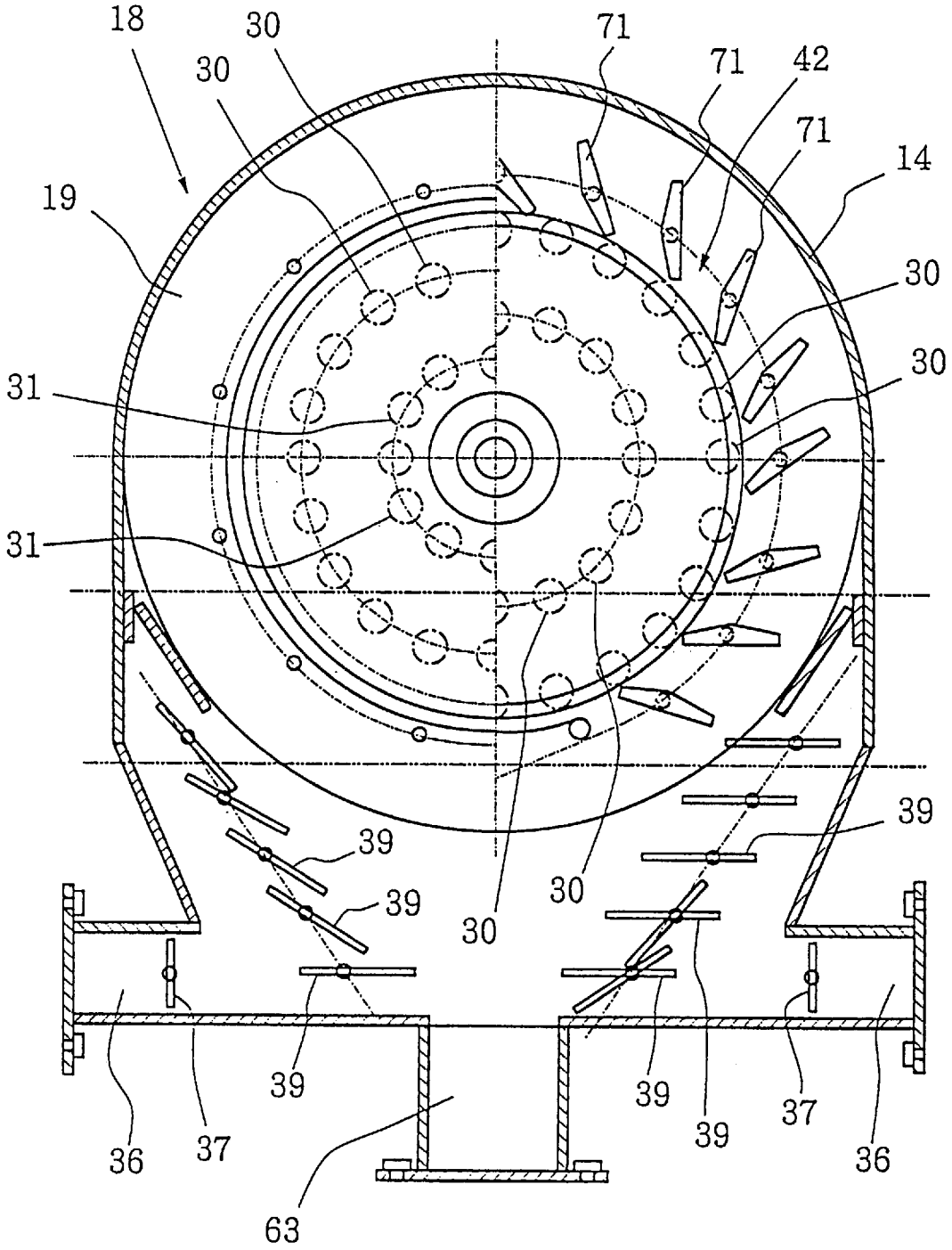
FIG. 2 is a cross-sectional view showing a crushing chamber of the crusher shown in FIG. 1.
Figure 3:
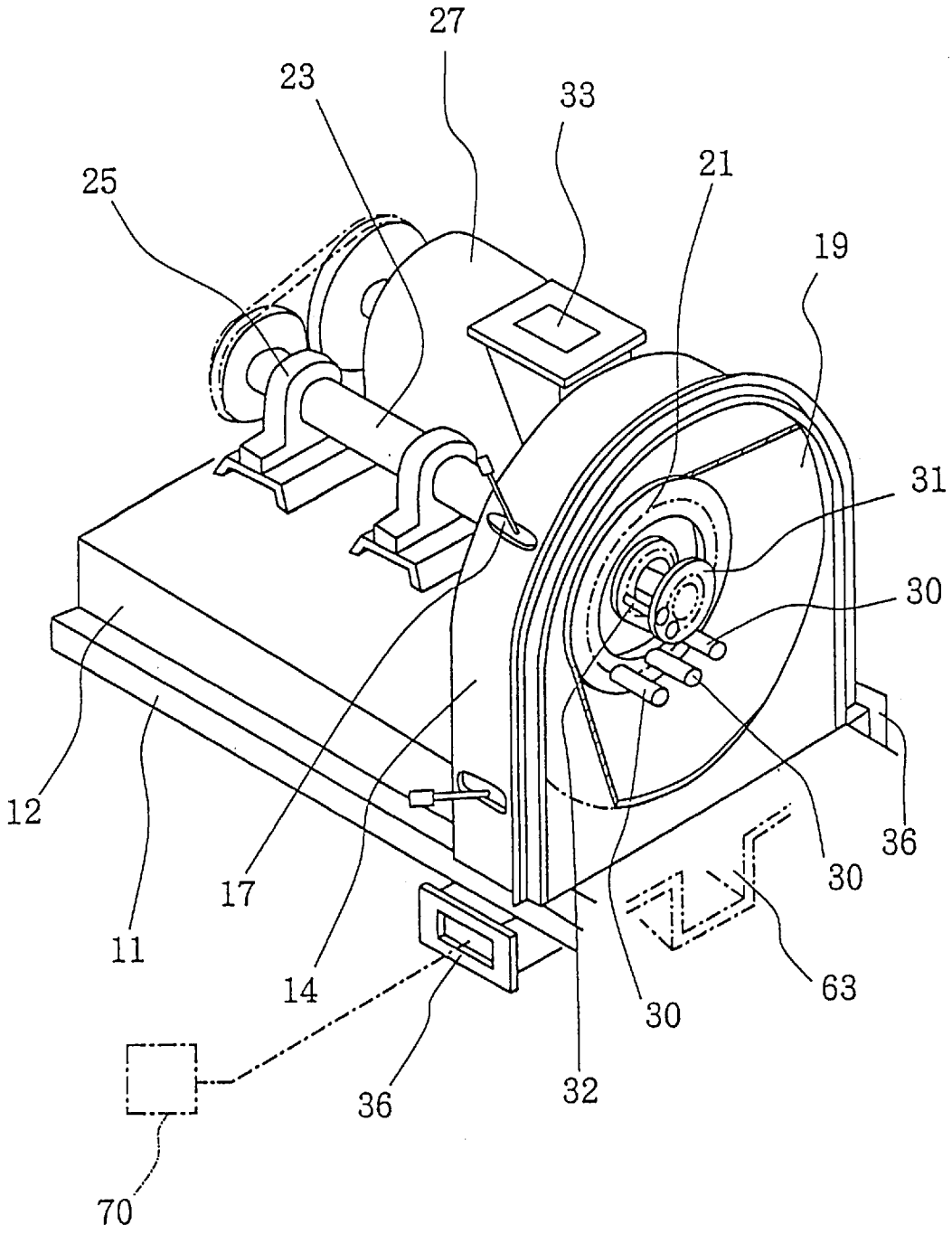
FIG. 3 is a perspective view showing the left side portion of the crusher shown in FIG. 1.
Figure 4:
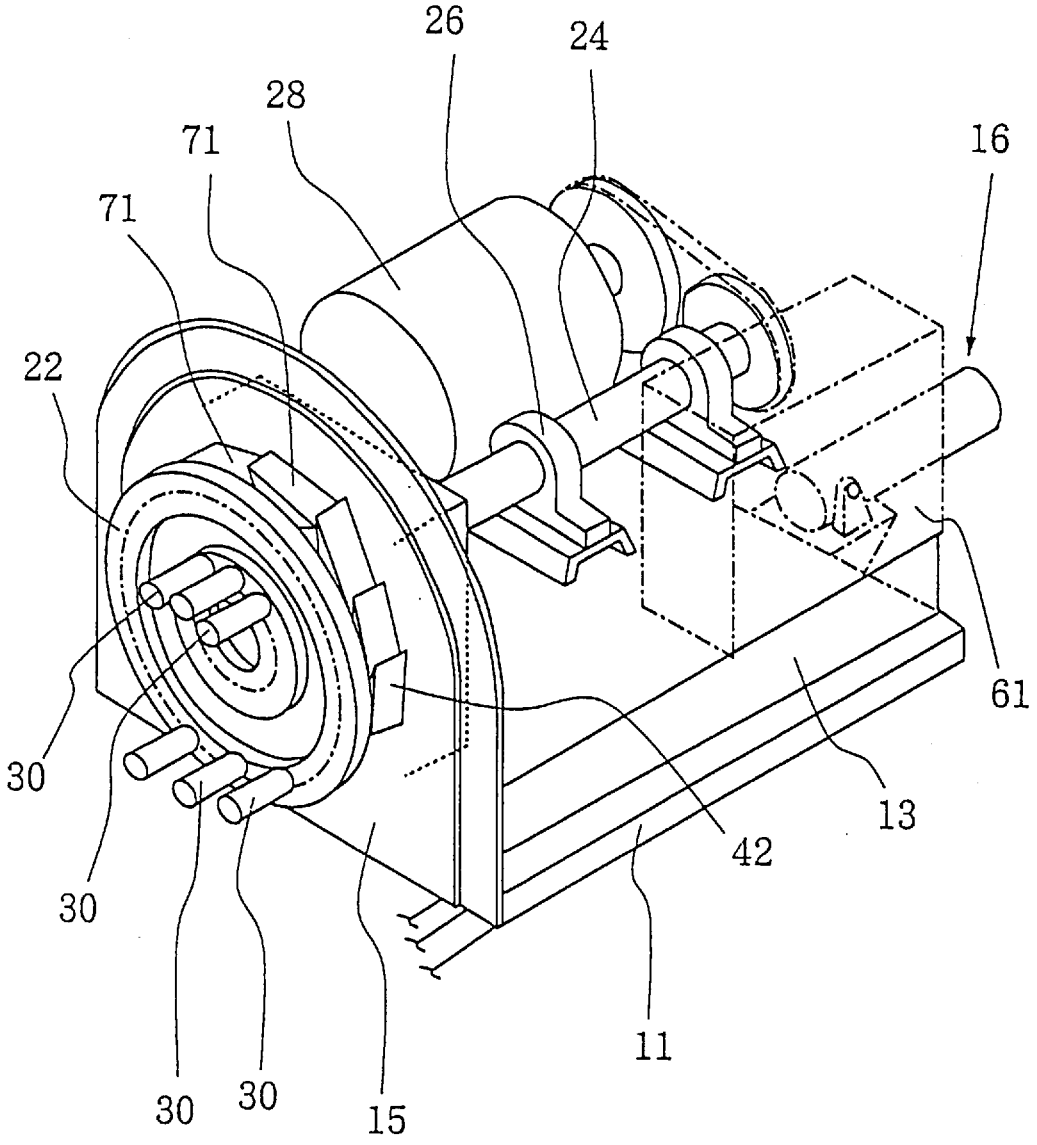
FIG. 4 is a perspective view showing the right side portion of the crusher shown in FIG. 1.

The crushing operation is carried out in the state where the movable column 13 is moved to left as shown in FIG. 1. The maintenance work is carried out in the state where the movable column 13 is moved to right, and the crushing chamber 18 is opened.

A fixing member 17 for the casing is arranged on the outer periphery of the casings 14 and 15.

In the crushing operation, the casings 14 and 15 are integrated by the fixing member 17. When the movable column 13 is moved to right, the fixing member 17 is released.

An annular impact plate 19 opened rightward in a tapered fashion is secured to the inside of the casing 14. The impact plate 19 defines a crushing area along with the casings 14 and 15.

A first rotor disk 21 and a second rotor disk 22 are supported within the crushing area.

A number of metal pins 32 and crushing pins 30 are detachably secured to the right surface of the first rotor disk 21 along the double circle so as to constitute the first and third rows, respectively. The outer crushing pin 30 is mounted in a cantilever manner. This crushing pin 30 will be described in detail later.

On the other hand, the inner metal pin 32 is mounted in a double end manner, the other end of which is secured to the left surface of the disk 31.

The disk 31 is secured to one end of a shaft 23 through a hub 2. Accordingly, when the shaft 23 rotates, the disk 31 and the first rotor disk 21 rotate along with the shaft 23.

A number of crushing pins 30 are secured to the left surface of the second rotor disk 22 along the double circle so as to constitute the second and fourth rows. This crushing pin 30 is mounted in a cantilever manner similar to the crushing pin 30 of the first rotor disk 21.

The crushing pins 30 of the first and second rotor disks 21 and 22 are alternately arranged as shown in FIGS. 1 and 9 so that the crushing pins 30 of the rotor disks are lined up with clearances Y1, Y2 and Y3.

As will be apparent from FIGS. 1 and 9, an escape space 22*a* is formed in the second rotor disk 22 so as to face to the extreme end of the crushing pin 30 on the side of the first rotor disk 21, and escape spaces 21*a* and 21*b* are formed in the first rotor disk 21 so as to face to the extreme end of the crushing pin 30 on the side of the second rotor disk 22. These escape spaces 21*a* , 21*b* and 22*a* function as spaces into which crushed raw materials run temporarily. Let Y be the maximum distance between the crushing pin 30 on the side of the first rotor disk 21 and the crushing pin 30 on the side of the first rotor disk 22, and X be the minimum distance between the extreme end of each of the crushing pins 30 and the bottom of the escape spaces 21*a* , 21*b* and 22*a* of the first rotor disk 21 or the second rotor disk 22 facing thereto, and then the relationship of X>Y is established.

This will be described in more detail. In the rotating state, let Y1 be the distance (clearance) between the metal pin 32 of the first row and the crushing pin 30 of the second row on the side of the second rotor disk 22, Y2 be the distance (clearance) between the crushing pin 30 of the second row on the side of the second rotor disk 22 and the crushing pin 30 of the third row on the side of the first rotor disk 21, and X1 be the distance between the extreme end of the crushing pin 30 of the second row on the side of the second rotor disk 22 and the bottom of the escape space 21*a* of the first rotor disk 21, and then the relationships of X1>Y1 and X1>Y2 are established. Preferably, X1 is less than ½ the length L of the crushing pin 30, particularly, ⅓ to ½.

Preferably, the crushing pins 30 of the other rows are similarly constructed.

That is, in the rotating state, let Y2 be the distance (clearance) between the crushing pin 30 of the third row on the side of the first rotor disk 21 and the crushing pin 30 of the second row on the side of the second rotor disk 22, Y3 be the distance (clearance) between the crushing pin 30 of the third row on the side of the first rotor disk 21 and the crushing pin 30 of the fourth row on the side of the second rotor disk 22, X2 be the distance between the extreme end of the crushing pin 30 of the third row on the side of the first rotor disk 21 and the bottom of the escape space 22*a* of the second rotor disk 22, and X3 be the distance between the extreme end of the crushing pin 30 of the fourth row on the side of the second rotor disk 22 and the bottom of the escape space 21*b* of the first rotor disk 21, and then the relationships of X2>Y2, X2>Y3, and X3>Y3 are established. Preferably, X2 and X3 are less than ½ of the length of the crushing pin 30, particularly, ⅓ to ½.

With respect to the escape spaces 21*a*, 21*b* and 22*a*, preferably, X1, X2 and X3 are 5 mm or more.

In FIG. 9, the relationship of Y1>Y2>Y3 is established, and the relationship of X1=X2=X3 exists. When the maximum Y1 is compared with the minimum X3, the relationship of X3>Y1 is established.

Preferably, the distance (clearance) between the crushing pin 30 and the adjacent pin 30 or 32 in the rotating state is ⅓ to 3 times the size of raw materials.

Preferably, the aforementioned escape spaces 21*a*, 21*b* and 22*a* are in the form of an annular groove having the depth of Z1 and Z2 and arranged concentrically with each of the pins. Preferably, the cross section of each of the escape spaces 21*a*, 21*b* and 22*a* is rectangular, but other shapes may also be employed.

The optimal conditions are as follows.

Y1, Y2 and Y3 are determined according to the size of raw materials and the request crushing grain size. Z1 and Z2 are determined according to the size of raw materials charged. Let W be the diameter of raw materials charged, and then preferably, with respect to Z, and then the relationships of Z1≧Z2, and Z=W/3 to 5W are established. Preferably, with respect to X, the relationship of X1≧X2 is established, while the relationships of X1-Z1 and X2-Z2=0 to 2W are established.

The diameter of raw materials charged is 5 to 25 mm, and the peripheral speed for the first rotor is 35 m/sec, and that for the second rotor is 35 m/sec. Data obtained from the experiments conducted using andesite are as follows:

| Test No. | X1, X2 (mm) | Z1, Z2 (mm) | Production (kg/hr) | Grain Size (rate of occurrence of 2.5 mm or more) |
|---|---|---|---|---|
| No. 1 | 13 | 20 | 801 | 24.4% |
| No. 2 | 20 | 20 | 1,132 | 25.6% |
| No. 3 | 27 | 20 | 1,634 | 26.7% |
| No. 4 | 34 | 20 | 2,338 | 37.4% |

The illustrated embodiment will be again explained. The second rotor disk 22 is secured to one end of a shaft 24 through a hub 3.

The shafts 23 and 24 are rotatably supported by bearings 25 and 26 on the column 12 and the movable columns 13. The shaft 23 and 24 can be rotated by drive motors 27 and 28 in the direction opposite to each other at their respective desired speeds.

The casing 14 is provided with a charging opening 33 for charging materials to be crushed such as stones, gravels, grain, etc. The upper part of the charging opening 33 is opened upward, and the lower part thereof is opened toward the left surface of the disk 31, around the shaft 23.

The crushing chamber 18 has a product outlet 63 for recovering products obtained by crushing, mounted in the vicinity of the central portion at the lowest part thereof. The products drop under gravity from between the impact plate 19 and the casing 15, and are recovered.

The crushing chamber 18 has an annular pulverized-powder outlet 34 formed in the central portion on the right hand thereof. The inner periphery of the pulverizing outlet 34 is defined by a pressure loss reducing cover 38. An opening degree of the pulverizing outlet 34 can be adjusted by a classifying throttle plate 35 arranged in the casing 15. A pulverized-powder recoverer may be connected to the pulverized-powder outlet 34.

The crushing chamber has classifying air supply ports 36 for feeding air to the crushing chamber 18, mounted on this side and opposite side at the lower part (see FIGS. 1 and 3) thereof. A blower or an air feeder 70 for feeding (classifying air is connected to the classifying air supply port 36.

A plate-like classifying air-amount adjusting plate 37 for adjusting an air amount is rotatably arranged on the inside of a classifying air intake 36. The throttling of a flowpassage for classifying air is adjusted by the classifying air-amount adjusting plate 37.

Plate-like classifying air-direction adjusting plates 39 are arranged in a row in the area on the further inside of the classifying air-amount adjusting plate 37. The classifying air-direction adjusting plates 39 are rotatably set to thereby suitably adjust the direction of the classifying air.

On the left surface of the casing 15 are arranged a number of plate-like classifying guide valves 71 along the circle. The classifying guide valves 71 can be fixed at desired angles.

The left end surfaces of the classifying guide valves 71 are positioned on substantially the same plane as the right surface of the second rotary disk. The inner side of the classifying guide valve 71 is positioned on substantially the outer periphery of the second rotor disk (see FIGS. 1 and 2).

Between the second rotor disk and the casing 15 is formed a classifying chamber 40 whose outer periphery is defined by the classifying guide valve 71 and whose inner periphery is defined by the pressure loss reducing cover 38. A clearance 42 between the classifying guide valves 71 adjacent to each other serves as an inlet of the classifying chamber 40.

A number of classifying blades 41 are arranged along the inner periphery on the right surface of the second rotor disk 22. The classifying blade 41 is a member L-shaped in section. The classifying blade 41 rotates (along with the second rotor disk 22) within the classifying chamber 40 to outwardly remove the crushed products having a fixed grain size or more. Pulverized powder having a fixed grain size or less can move inside the rotational area of the classifying blades 41.

Classifying air introduced into the crushing chamber 18 enters the classifying chamber 40 from the inlet 42, flows in the direction of the center shaft and is discharged out of the pulverized powder outlet 34.

The crushing pin 30 will be described with reference to FIGS. 5 to 8.

The crushing pin 30 is composed of a pin-like metal member 44 a tubular ceramic member 43.

The metal member 44 is secured to the rotor disk 22 in a cantilever manner by means of a nut 54 and a spring washer 55. A protecting ceramic member 49 is secured to the outside of the rotor disk 22.

The metal member is generally tapering, and the ceramic member 43 is tubular having a through-hole corresponding to the former.

A rubber tape 51 and a rubber packing 53 are arranged between the metal member 4 and the ceramic member 43.

The buffer members are so arranged as to prevent concentration of stress and prolong the service life of both the members.

Figure 6:
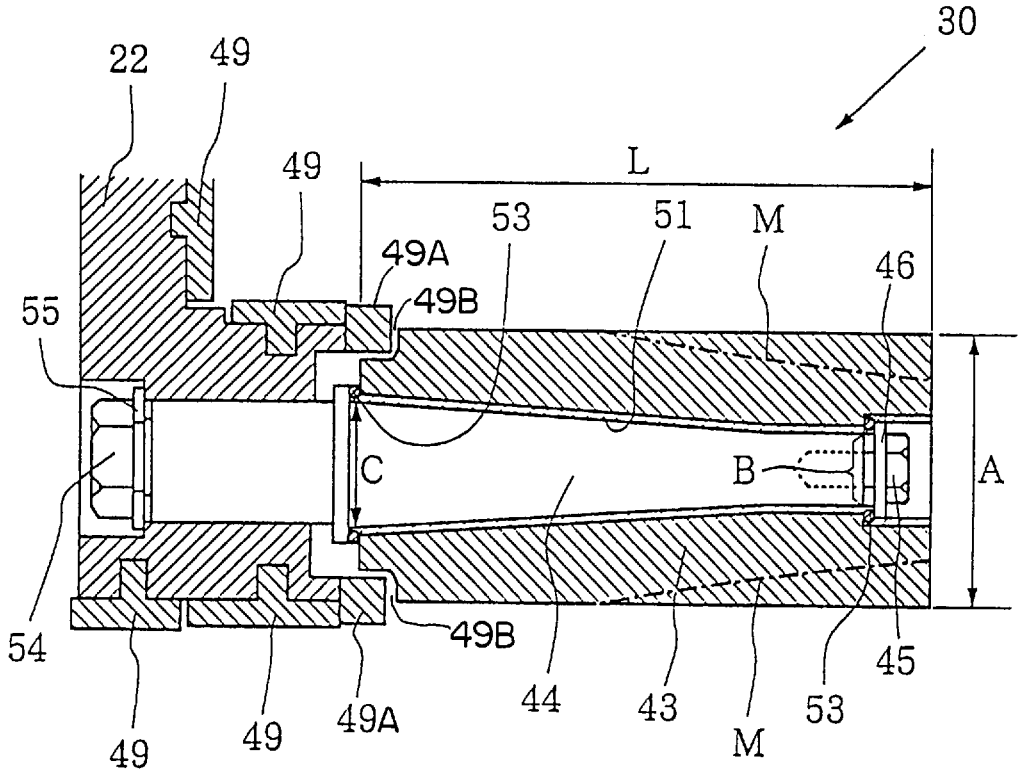
FIG. 6 is a sectional view showing one embodiment of a crushing pin.

In the embodiment shown in FIG. 6, the ceramic member 43 is secured to the metal member 44 by means of a mounting nut 45 and a washer-like keep member 46.

Figure 7:
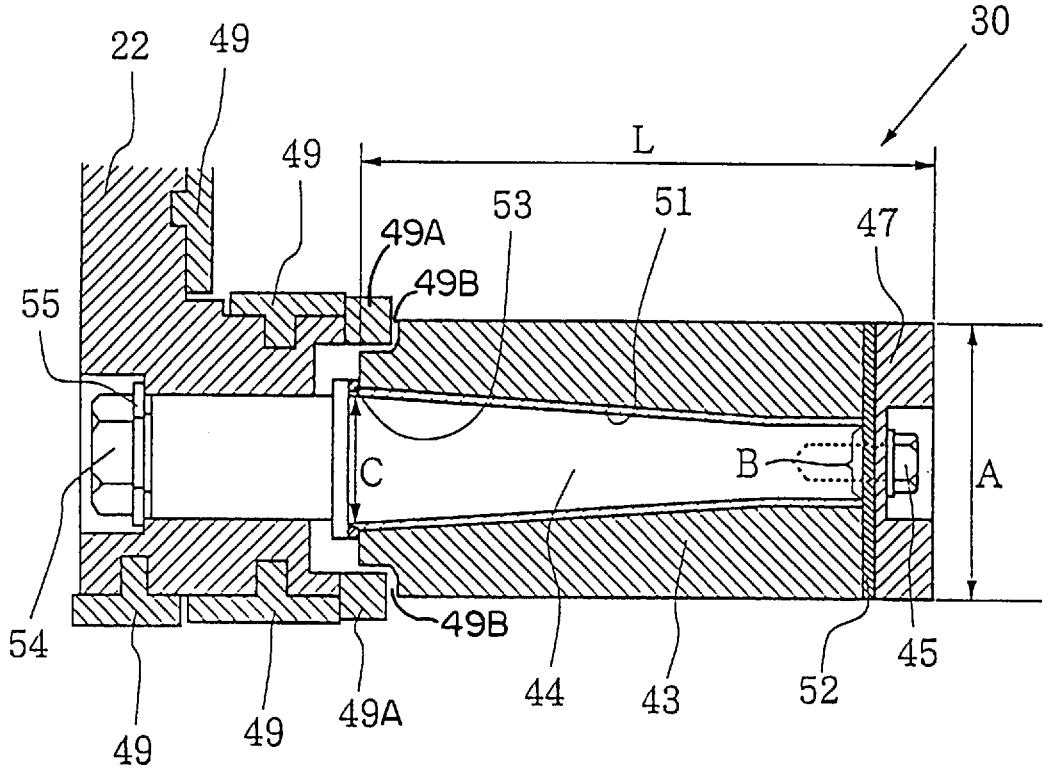
FIG. 7 is a sectional view showing a further embodiment of a crushing pin.

In the embodiment shown in FIG. 7, a keep member 47 has the same outside diameter as that of the ceramic member 43. A rubber tape (rubber packing) 52 is arranged between the keep member 47 and the ceramic member 43. In this embodiment, a contact area of the keep member 47 is so large that the mounting strength can be increased.

Figure 8:
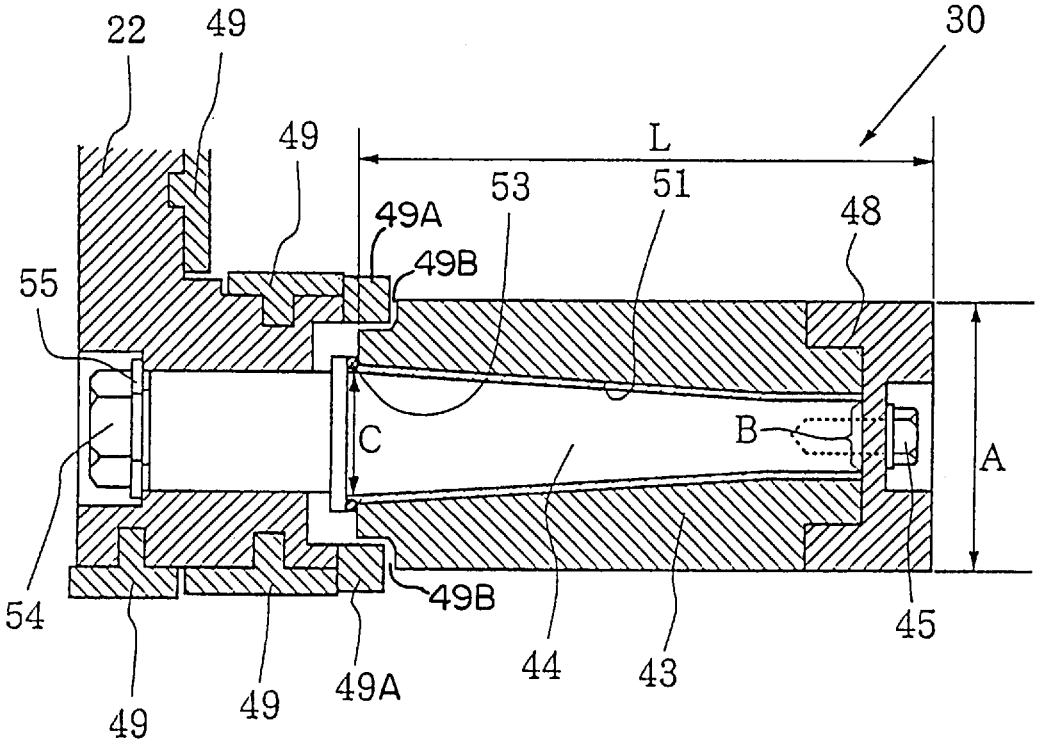
FIG. 8 is a sectional view showing still another embodiment of a crushing pin.

In the embodiment shown in FIG. 8, a joining surface of a keep member 48 is concave, and a contact area thereof against the ceramic member 43 is large. Accordingly, the entire extreme ends of the ceramic member 43 and the metal member 44 are protected, and the mounting strength increases.

Figure 5:
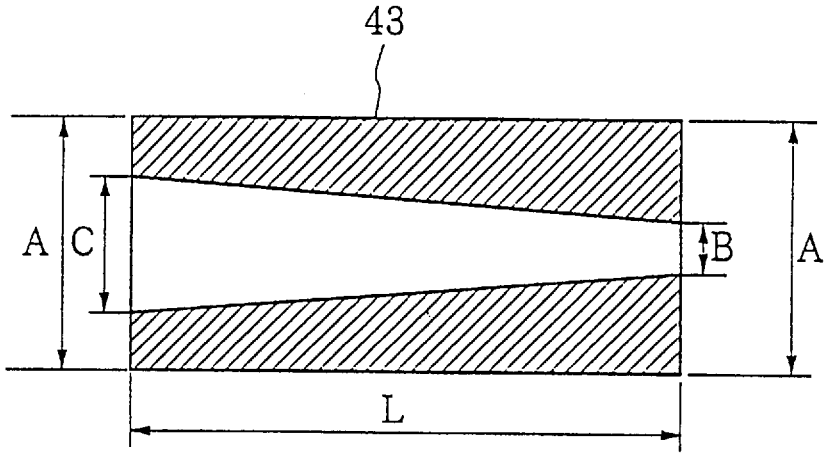
FIG. 5 is a sectional view showing a ceramic member constituting a crushing pin.

Next, the dimensional configuration of the ceramic member 43 and the metal member 44 will be described with reference to FIG. 5.

In the metal member, the diameter C of the root portion is 1.0 to 7.0 times the diameter B of the extreme end. The reason why such a tapering shape is provided is that even in the cantilever system, the strength enough to support the ceramic member 43 and withstand the crushing force is secured, and the crushing efficiency to some extent can be obtained. More preferable values are 1.4 to 3.5 times.

The outer peripheral shape of the ceramic member 43 is for example cylindrical. In this case, preferably, the diameter C of the root portion of the metal member 44 is ¼ to ½ times or ⅓ to ⅗ times the outside diameter A of the ceramic member 43. By the provision of the dimensional configuration as described above, it is possible to secure the sufficient strength of the ceramic member 43 and the metal member 44 and to make the balance of the strength therebetween appropriate.

The operation of the aforementioned crusher 10 will be briefly described below.

If the maintenance is necessary prior to crushing, the fixing member 17 is released, the retractor 16 is operated, and the movable column 13 is moved rightward in FIG. 1 to open the casings 14 and 15. And then, the maintenance is performed.

Since the crushing pin 30 is of the cantilever system and the band and the ring are not mounted at the extreme end, it is possible to remove only the broken pin to replace it simply, being extremely efficient.

Upon completion of the maintenance, the moving means 16 is operated to move the movable column 13 leftward, and the casings 14 and 15 are combined. The casings 14 and 15 are firmly integrated by the fixing member 17.

Thereafter, the crushing operation is started.

The motors 27 and 28 are operated to rotate the first and second rotor disks 21 and 22 in the direction opposite to each other at the fixed speed, respectively. The blower 70 is operated to feed classifying air into the classifying air intake 36. Materials to be crushed in a suitable quantity are charged through the charging opening 33. The classifying air-amount adjusting plate 37 and the classifying air-direction adjusting plate 39 are set to the desired angle in advance to adjust the flow rate and the direction of the classifying air.

The materials to be crushed enter from the crushing chamber inlet 56 into the crushing chamber 18 and are fed to the radial outer area while being rolled in the rotation of the metal pin 32. In that area, the crushing pins 30 are lined up in a triple row and rotate in the direction opposite to each other.

The materials to be crushed are crushed in that area by the mutual action of the triple row of the crushing pins 30 and vigorously scattered toward the further outer area. At that time, a part of the materials to be crushed escape toward the escape spaces 21*a*, 21*b* and 22*a* and are then moved to the outer periphery.

This will be further explained. The materials to be crushed are first crushed by the first row of pins 32 and the second row of pins 30, and a part thereof moves toward the escape space 21*a* of the first rotor disk 21. Thereafter, the materials to be crushed are crushed by the second row of pins 32 and the third row of pins 30. At this time, a part of the materials to be crushed moves toward the escape space 22*a* of the second rotor disk 22. Then, the materials to be crushed are crushed by the third row of pins 30 and the fourth row of pins 30. At this time, a part of the materials to be crushed moves toward the escape space 21*b* on the side of the first rotor disk 21. The crushed materials finally vigorously collide with the outermost impact plate 19 in the crushing area and a part of the crushed material is further finely crushed. Since the impact plate 19 is opened on the right side in a tapered fashion, the crushed material is fed rightward wholly.

The classifying air fed into the crushing chamber 18 enters from the inlet 42 into the classifying chamber 40 and is discharged out of the pulverized-powder outlet 34. Accordingly, relatively small-sized crushed materials are carried by this air and fed from the inlet 42 into the classifying chamber 40.

On the other hand, relatively large-sized crushed materials not carried by air drop due to gravity and are recovered from the product outlet 63. The crushed materials failed to be entered or not entered from the classifying chamber inlet 42 into the classifying chamber 40 also drop due to gravity and are recovered from the product outlet 63.

The classifying blade 41 rotates within the classifying chamber 40. Therefore, those out of the crushed materials fed into the classifying chamber 40 which exceed the fixed grain size are obstructed by the classifying blade 41 and cannot be entered inside from the rotational area. Such crushed materials are sprung out by the classifying blade 41 and drop due to gravity, and are recovered from the product outlet 63 passing through the classifying chamber inlet 42.

The pulverized powder fed to the classifying chamber 40 and moved into the rotational area of the classifying blade 41 is discharged out of the pulverized-powder outlet 34 by the classifying air.

The crushed product recovered from the product outlet 63 as described above is the classified product not containing the pulverized powder. A degree of classification can be suitably controlled by the adjustment of the classifying air, the adjustment of the classifying guide valve 39, the adjustment of the classifying blade 41, and the adjustment of the rotor disks (particularly, the second rotor disk 22).

Preferably, ceramic material whose bending strength is 500 MPA (Mega Pascal) or more is used as material for the ceramic member of the crushing pine 30.

In case of the metal member 30 of the taper system as in the illustration, the bending strength of the metal member for the crushing pin is high as the root is thick. With respect to the worn part (place), when the crushing is performed, the extreme end of the ceramic member of the crushing pin becomes worn. Therefore, when the taper type system of the iron core in ceramics is employed, the economical effect of the bending strength and the abrasion property increases.

As long as the round of the extreme end of the crushing pin is 3 mm or more in diameter, no crack or defect occurs at the extreme end of the crushing pin (ceramics) even if raw materials to be crushed are 5 mm or more in diameter.

Possible size of raw materials to be crushed is 5 mm or less, and even up to 10 mm or more to 60 mm.

When the crushing pin is assembled in the taper style by the ceramic member and the metal member, the weight of the extreme end decreases. Therefore, the mechanical vibration disappears, and the possible rotational speed of the crushing rotor is 30 m/s to 70 m's. Further, the vibration is reduced, and the service life of the bearings is extended.

When the impact plate 19 is provided on the surface opposite to the outer crushing pin, crushed materials will not enter between the rotor disks 21, 22 and the casings 14, 15, which are hard to be worn. Preferably, the left end of the impact plate 19 is in the position equivalent to or outside the extreme end of the crushing pin 30.

If the distance between the extreme end of the crushing pin and the impact plate 19 is set to be at least 0.5 to 1.5 times the maximum diameter of raw materials, the crushed materials having the maximum diameter will never fly into the product.

According to the aforementioned crusher, since the crushing pin is detachably mounted in a cantilever manner, the maintenance can be carried out efficiently, and since the crushing pin has a sufficient strength, the durable service life can be considerably prolonged.

The present invention is not limited to the aforementioned embodiment. For example, the rows of the crushing pins 30 to be mounted along the circumference of the rotor disks 21 and 22 are not limited to two rows but may be one row or three rows or more. Either of the rotor disks 21 and 22 may be of the fixed type.

Further, the classifying air is not blown from the classifying air intake but may be drawn into the crushing chamber (classifying chamber) with the side of the pulverized-powder outlet decompressed.

The outer portion of the crushing pin 30 is preferably made of ceramics in terms of the durable service life. However, that is not limited to those using the ceramic member 43 but other hard materials (such as hard metal) may be used instead.

Further, the crushing pin 30 is not limited to a sleeve-like shape having a tapered hole as in the illustration. However, since a part of the crushed materials moves toward the escape spaces 21*a*, 21*b* and 22*a*, the crushing pin 30, which was at first cylindrical, becomes worn little by little from the extreme end thereof as indicated by the chain line M in FIG. 6 to form a tapering outer peripheral surface. Therefore, a sleeve having a tapered hole is longer in durable service life.

What is claimed is:

1. A crushing pin type crusher comprising a casing, a first rotor disk (21), a second rotor disk (22), a plurality of crushing pins (30) mounted on the first and second rotor disks (21, 22) so as to form a plurality of rows within the casings (14, 15), wherein at least one of the first and second rotor disks (21, 22) is rotated to crush materials which are charged into the casings (14, 15), wherein the crushing pins (30) have metal members (44) mounted on the first and second rotor disks (21, 22) in a cantilever manner, and tubular ceramic members (43) detachably mounted on the metal members (44), and a ceramic protecting member (49A) fixed to the second rotor disk (22) wherein an L-shaped clearance (49B) in a cross section is formed along a root end periphery of the tubular ceramic member (43) between the tubular ceramic member (43) and the second rotor disk (22).

2. The crushing pin type crusher according to claim 1, wherein the relationship of X>Y is established, assuming that Y be the maximum radial distance between the crushing pin (30) on the side of the first rotor disk (21) and the crushing pin (30) on the side of the second rotor disk (22), and X be the minimum axial distance between the extreme end of each crushing pin (30) and the bottom of the escape space (21*a*, 22*a*) of the first rotor disk (21) or the second rotor disk (22) facing thereto.

3. The crushing pin type crusher according to claim 2, wherein said escape space is annular.

4. The crusher according to claim 1, wherein the escape space is provided in the rotor disks (21, 22) so that the end of the crushing pin (30) may face thereto.

5. The crusher according to claim 1, wherein the rotor disks (21, 22) are rotated in the second direction opposite to each other, and the relative speed of the crushing pins (30) which rotate in the opposite direction is utilized to effect crushing.

6. The crusher according to claim 1, wherein a plurality of classifying blades (41) are arranged on the second rotor disk (22), and classifying air direction adjusting means (39) for adjusting the direction of classifying air is provided within the casing (14, 15).

7. A crusher comprising a casing (14, 15), a rotor disk (21, 22), a plurality of crushing pins (30) mounted on the rotor disk within the casing (14, 15), wherein the rotor disk (21, 22) is rotated to crush materials which are charged into the casing (14, 15), wherein each of the crushing pins (30) comprises a metal member (44) mounted on the rotor disk (21, 22) in a cantilever manner and a tubular ceramic member (43) detachably mounted on the metal member (44), the metal member (44) having generally a tapering portion, and a largest diameter (C) of the tapering portion of the metal member (44) is 1.4 to 3.5 times a smallest diameter (B), wherein the outer shape of the ceramic member (43) is generally cylindrical, and the largest diameter (C) of the metal member (44) is ¼ to ½ times an outside diameter (A) of the ceramic member.

8. The crusher according to claim 7, wherein the ceramic member (43) is generally cylindrical, and the length of the ceramic member (43) and the metal member (44) is 1.2 to 5 times the outside diameter (A) of the ceramic member (43).

9. The crusher according to claim 7, wherein a packing member (51) is arranged between the metal member (44) and the ceramic member (43).

10. The crusher according to claim 9, wherein the packing member is rubber tape.

11. The crusher according to claim 7, wherein keeping members (47,48) are arranged at the ends of the ceramic member (43) and the metal member (44), said keeping members (47, 48) being so constituted as to be secured to the metal member (44) by means of a mounting nut (45), and a joining surface of the keeping members (47, 48) being flat or concave in section.

12. A crushing pin type crusher comprising a casing, a first rotor disk (21), a second rotor disk (22), a plurality of crushing pins (30) mounted on the first and second rotor disks (21, 22) so as to form a plurality of rows within the casings (14, 15), wherein at least one of the first and second rotor disks (21, 22) is rotated to crush materials which are charged into the casings (14, 15), wherein the crushing pins (30) have metal members (44) mounted on the first and second rotor disks (21, 22) in a cantilever manner, and tubular ceramic members (43) detachably mounted on the metal members (44), and a protecting member (49A) fixed to the second rotor disk (22) wherein an L-shaped clearance (49B) in a cross section is formed along a root end periphery of the tubular ceramic member (43) between the tubular ceramic member (43) and the second rotor disk (22).

* * * * *